US006394292B1

(12) United States Patent
Sabounjian

(10) Patent No.: US 6,394,292 B1
(45) Date of Patent: May 28, 2002

(54) LAUNDRY STAND

(75) Inventor: Azad Sabounjian, Anaheim Hills, CA (US)

(73) Assignee: Pro-Mart Industries, Inc., Rancho Cucamonga, CA (US)

( * ) Notice: Subject to any disclaimer, the term of this patent is extended or adjusted under 35 U.S.C. 154(b) by 0 days.

(21) Appl. No.: 09/233,275

(22) Filed: Jan. 19, 1999

(51) Int. Cl.[7] ..... A47B 43/00

(52) U.S. Cl. ..... 211/202; 211/182

(58) Field of Search ..... 211/202, 195, 211/189, 200, 201, 182; 403/187, 188, 192, 194, 199, 201, 263–264, 341, 345, 408.1; 248/166, 163.1, 164, 176.1, 127, 439; 285/189, 397, 398

(56) References Cited

U.S. PATENT DOCUMENTS 482,269 A * 9/1892 North ..... 211/202
2,388,637 A * 11/1945 John ..... 211/202
3,133,645 A * 5/1964 Cecil ..... 211/202
3,236,387 A * 2/1966 Perini ..... 211/202
3,850,534 A * 11/1974 O'Halloran ..... 403/191
3,891,334 A * 6/1975 Loikitz ..... 403/199
3,960,275 A * 6/1976 Haughton et al. ..... 211/182
4,270,872 A * 6/1981 Kiyosawa ..... 403/263
4,290,532 A * 9/1981 Reynolds ..... 211/200
4,297,795 A * 11/1981 Licari ..... 211/200
4,358,214 A * 11/1982 Shull ..... 403/263
4,828,123 A * 5/1989 Basor ..... 211/202
5,149,149 A * 9/1992 Wu ..... 403/348
5,888,012 A * 3/1999 Nygren, Jr. et al. ..... 403/408.1
6,118,073 A * 9/2000 Lau et al. ..... 211/182
6,155,741 A * 12/2000 Took ..... 403/408.1

* cited by examiner

*Primary Examiner*—Daniel P. Stodola
*Assistant Examiner*—Jennifer E. Novosad
(74) *Attorney, Agent, or Firm*—Stetina, Brunda, Garred & Brucker

(57) ABSTRACT

A stand for supporting laundry includes a pair of oppositely disposed legs which are interconnected by one or more connecting rods. The legs are constructed of scissor linkages which allow the legs to be readily folded and unfolded, and cross members may be used to hold the legs in an open position. Advantageously, the laundry stand uses connectors which pivotably attach the scissor linkages and allow the connecting rods to connect the legs. In particular, the connectors have a first end configured to be fastened to the connecting rod and a second end configured to be inserted through an opening in one or both of the legs.

29 Claims, 10 Drawing Sheets

UP
RIGHT
LEFT
FRONT
DOWN
10
40
23
38
52
44
42
16
18
22
20
27
24
26
28
14
46
12
25
2
3
34
32
36

LAUNDRY STAND

FIELD OF THE INVENTION

The present invention generally relates to a stand and, in particular, to a stand for supporting laundry.

DESCRIPTION OF RELATED ART

Conventional laundry stands are often placed, for example, in a laundry room and it is often used to dry laundered items which should not be placed in a dryer. For example, items made of nylon or other materials, which may be damaged by the heat of the dryer, should be hung to dry. Additionally, items which may shrink in the dryer should be hung to dry. Laundry stands are also frequently used by people who do not own dryers or who would rather allow their laundered items to dry naturally. Laundry stands may also be used for temporary storage of clothing and other articles.

Conventional laundry stands frequently require numerous parts which makes assembly of the stands difficult and time consuming. These laundry stands may also require the use of bolts and screws which further increases the time required to assemble the stand. Additionally, if the stand is shipped disassembled, the consumer or receiver must disadvantageously spend a substantial amount of time and effort to assemble the stand. For these various reasons, it is difficult to ship laundry stands if they are disassembled. On the other hand, if the stands are shipped assembled, the postage and transportation costs are significant and it requires time and cost to assemble the stand before shipping it.

It is known to make laundry stands from wood, but the wood disadvantageously splits, deteriorates and decomposes over time. The wood also has a tendency to mildew, warp and deform. Additionally, the wooden surfaces often develop jagged or rugged surfaces which often grab and snag the laundry. Further, the wood has to be periodically replaced or refinished.

It is also known to construct laundry stands from polyvinyl chloride (PVC). Disadvantageously, if the racks are used outdoors, the racks may melt or deform in high temperatures and the PVC cracks and yellows because of the ultraviolet light from the sun. The cracking PVC components of the racks often snag and rip the clothes. Thus, conventional racks constructed from PVC can only be used indoors.

A need therefore exists for a laundry stand that is easy to manufacture, simple to assemble and eliminates the above-described problems.

SUMMARY OF THE INVENTION

The present invention is an improved laundry stand. The laundry stand includes a pair of oppositely disposed legs which are connected by one or more connecting rods. The legs and connecting rods are fastened together by a plurality of connectors. The connectors preferably securely connect the legs and connecting rods to create a stable laundry stand.

The present invention is advantageously easy to manufacture and simple to assemble. Significantly, the laundry stand of the present invention can be shipped either unassembled or partially assembled because the stand can be easily and quickly assembled when it is received. Thus, the laundry stand of the present invention decreases shipping costs. The laundry stand of the present invention is readily adjustable so that various items of laundry can be supported in a variety of positions, and the user can quickly modify the laundry stand according to the desired use of the stand. Therefore, the laundry stand can be used for a wide range of purposes.

One aspect of the present invention is a stand for supporting laundry. The stand includes a plurality of scissor linkages and connecting rods which are fastened together by connectors. The connectors advantageously allow the scissor linkages to be pivotably connected and the connectors allow the connecting rods to connect the first leg and the second leg. The stand may also include one or more pivotably connected cross bars which may be used to maintain the scissor linkages in an open position. Additionally, the stand may include a latching leg to secure one or both legs in a desired position.

Another aspect of the present invention is a connector for assembling a laundry stand. The connector includes a generally cylindrical body having a first end with an outside diameter larger than the outside diameter of a second end. The first end includes an opening which is configured to receive a connecting rod, and the inner surface of the opening preferably has a plurality a generally inwardly extending ribs that are configured to grip the connecting rod. The connector desirably includes a fastener with a shaft that is configured to be connected to the second end of the body.

Yet another aspect of the present invention is a connector for the laundry stand with a generally cylindrical body having a first end and a second end. The first end is configured to be inserted into an end of a connecting rod, and the second end is configured to be inserted into one or more openings in the legs of the rack. The connector preferably includes a fastener with a shaft that is configured to be connected to the second end of the body. Preferably, a collar is used to separate the first end of the connector from the second end.

Still another aspect of the present invention is a method of assembling a stand for supporting laundry. The method includes providing a plurality of elongated members and a plurality of connectors, each of the connectors having a first end with a larger outside diameter than a second end. Pairs of elongated members are pivotably connected by the connectors to form a plurality of scissor linkages and the scissor linkages are pivotably connected by the connectors to form a first leg and a second leg. The method also includes providing one or more connecting rods and fastening the connecting rods to the connectors to interconnect the first leg and the second leg.

The laundry stand of the present invention could be made of wood. For example, the legs may be constructed from wooden slats and the connecting rods may be constructed from wooden dowels. The wood is preferably treated to prevent mildew and decay. More preferably, the laundry stand is constructed from plastic. Significantly, the plastic stand can be used both indoors or outdoors, it is mildew resistant and it may be treated to resist damage from the sun, including protection from ultraviolet (UV) and infrared radiation. The plastic stand advantageously has smooth outer surfaces which do not snag or grab the clothes, and the plastic components lock together to form a sturdy and secure laundry stand. Of course, a portion of the stand may be constructed from wood and another portion constructed from plastic. For example, the legs may be constructed from wooden slats while the connectors and connecting rods are constructed from plastic or the legs and connecting rods may be constructed from wood while the connectors are made from plastic.

Additionally, the laundry stand is easy to ship and transport because the stand can be shipped either unassembled or partially assembled, and the unassembled or partially assembled stand fits into a small bag or enclosure during shipping. In addition, the stand is lightweight and, in contrast to the designs of conventional laundry stands, the laundry stand of the present invention may be quickly assembled into a secure and stable structure.

Another aspect of the invention is a connector for a laundry stand including a first tubular portion sized to receive a rod of the laundry stand and a second locking portion coaxial with the first portion and configured to engage a shaft of a fastener. The second locking portion is sized to extend through a member of the stand when engaged with the fastener such that a head of the fastener abuts the member to prevent the second locking portion from being removed from the member when the fastener is engaged with the second locking portion. The connector preferably includes a fastener having a shaft configured to engage the second locking portion and sized to cooperate with the second locking portion to cause a head of the fastener to abut the member when the fastener is engaged with the second locking portion.

Yet another aspect of the invention is a kit for constructing a stand to support laundry. The kit includes a plurality of connectors, each of the connectors having a first end with a larger outside diameter than a second end, and a plurality of pairs of elongated members. Each pair of elongated members has aligned holes through which a connector can be inserted to pivotably connect the pair of members to form a scissor linkage, and the ends of each pair of scissor linkages have corresponding holes through which connectors can be inserted to join two scissor linkages. At least two scissor linkages are joinable to form a first leg, and at least two scissor linkages are joinable to form a second leg. The kit also includes a plurality of connecting rods configured to be fastened to one end of the connectors to interconnect the first leg and the second leg. Desirably the kit includes one or more cross bars configured to be pivotably connected to distal ends of a pair of members forming a scissor linkage.

Still another aspect of the present invention is a connector with a body having a first end and a second end. A cavity is located in one end of the body and an outwardly extending flange is positioned between the ends. The body also includes a radially extending protrusion adjacent a distal end of one of the first and second ends. Preferably, the first and second ends are cylindrical and have substantially the same diameter. The connector also includes a fastener with a shaft configured to be press fit into the cavity, the fastener having an enlarged head. The second end of the connector body is inserted through an opening in at least one member of a laundry stand and the opening is configured so that the flange does not pass through the opening. Additionally, the enlarged head of the fastener does not pass through the opening when the shaft of the fastener is inserted into the cavity. Desirably, the first end of the connector includes protrusion to restrain disengagement of the connector and the connecting rod.

Still yet another aspect of the present invention is a connector having an elongated body with a first annular portion sized to engage an opening in a rod of the laundry stand and a second locking portion coaxial with the first portion. The second locking portion is sized to extend through an opening in at least one member of the rack and the body having an outwardly extending restraining portion. The connector also includes a fastener having a shaft and a head, the shaft is sized and configured to be inserted into an opening in the second locking portion, wherein when the second locking portion of the elongated body extends through the opening in the member and the fastener can be attached to the second end of the elongated body with the head of the fastener being configured to restrain passage of the head through the opening in the member. Preferably, the connector further includes a collar positioned between the first annular portion and the second locking portion, the collar being sized larger than the opening in the member of the laundry stand to prevent the entire connector from passing through the opening in the member.

Yet another aspect of the invention is a connector having an elongated body with a first end configured to be attached to a connecting rod and a second end configured to be inserted through one or more openings in a support leg. The first end of the connector includes one or more projections which are configured and located to engage one or more recesses in a connecting rod. This engagement of the projections and the recesses desirably securely attaches the connector to the connecting rod. The second end of the connector includes a radially outwardly extending flange which prevents the connector from passing the openings in the support legs. Additionally, the second end of the connector may include a longitudinally extending shaft with a disk mounted to the end of the shaft. The shaft and disk are preferably configured to be releasably connected to a cross bar.

Moreover, it is preferable that at least one of the engaged connectors and its engaged connecting rods have a protrusion and the other of the engaged connector or connecting rod have a correspondingly located recess so the protrusion and recess engage to fasten the rod to the connector. Advantageously, the protrusion is resiliently urged in to engagement with the recess to form a releasable, snap-lock connection.

Further aspects, features and advantages of the present invention will become apparent from the detailed description of the preferred embodiment that follows.

BRIEF DESCRIPTION OF THE DRAWINGS

The appended drawings contain figures of preferred embodiments of the present laundry stand. The above-mentioned features of the laundry stand, as well as other features, will be described in connection with the preferred embodiments; however, the illustrated embodiments are only intended to illustrate the invention and not to limit the invention. The drawings contain the following figures.

DETAILED DESCRIPTION OF THE PREFERRED EMBODIMENT

The present invention involves an improved laundry stand. The principles of the present invention, however, are not limited to laundry stands and it will be understood that, in light of the present disclosure, the laundry stand disclosed herein can be successfully used in connection with other types of stands and supports.

Additionally, to assist in the description of the components of the laundry stand, words such as left, right, up, down, front and rear are used to describe the accompanying figures. It will be appreciated, however, that the laundry stand can be located in a variety of different positions and orientations-including at various angles, sideways and even upside down. A detailed description of the laundry stand now follows.

Figure 1:
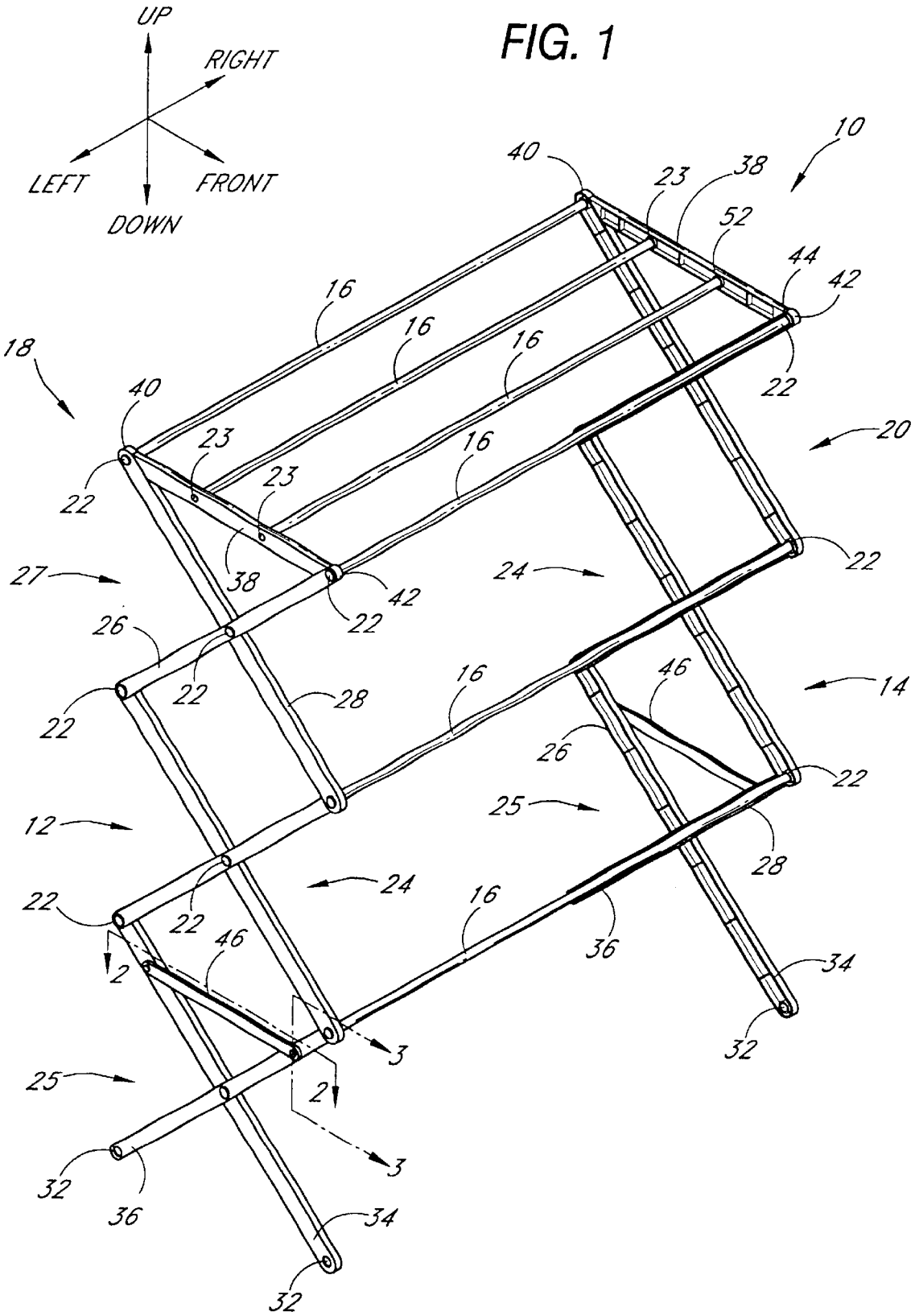
FIG. 1 is a perspective view of the laundry stand in accordance with a preferred embodiment of the present invention.

FIG. 1 illustrates a preferred embodiment of the laundry stand 10. In general, the laundry stand 10 includes oppositely disposed first and second legs 12 and 14 which are interconnected by one or more connecting rods 16. As described below, the connecting rods 16 may be attached to the upper portion 18 and/or lower portion 20 of the laundry stand 10. The legs 12 and 14 are preferably fastened together by connectors 22 that are advantageously configured to receive an end of the connecting rods 16. It will be understood that the connector 22 is used to generally refer to any of the various connectors used in conjunction with the laundry stand 10 and in particular to the connectors 50, 80, and 110 described in more detail below.

Figure 4:
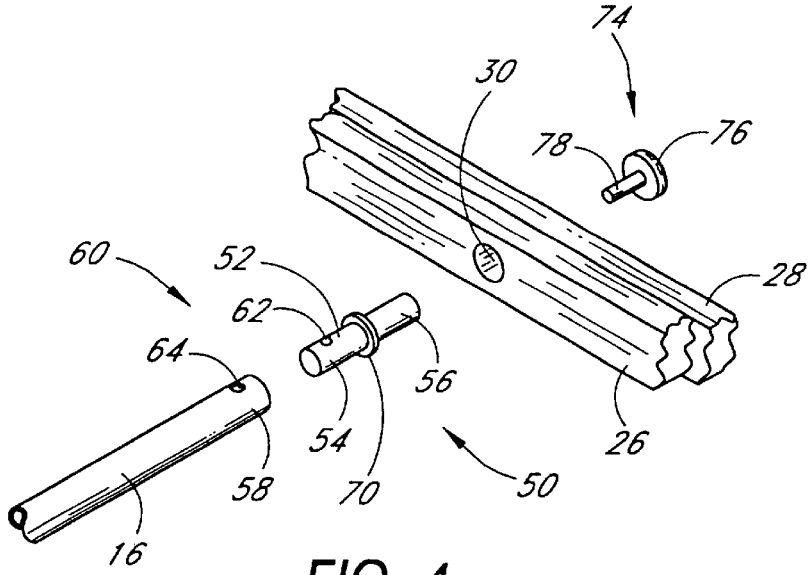
FIG. 4 is an exploded, enlarged perspective view of a preferred embodiment of a connector configured to extend through two leg members or a leg member and a cross bar.
Figure 9:
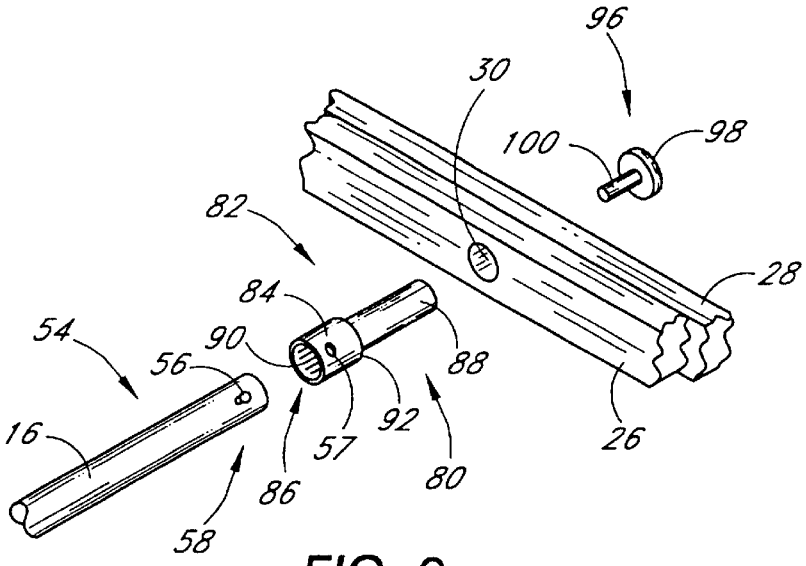
FIG. 9 is an exploded, enlarged perspective view of another preferred embodiment of a connector, illustrating a connector configured to extend through two leg members or a leg member and a cross bar.
Figure 10:
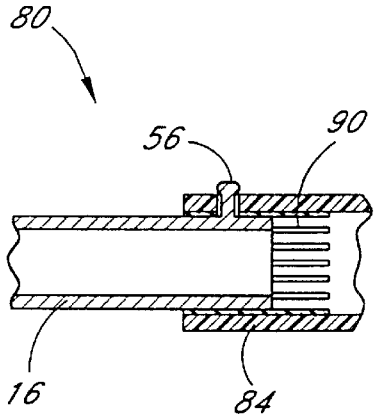
FIG. 10 is a cross sectional side view of the connector shown in FIG. 9 attached to a connecting rod, with a portion of the connector and connecting rod cut away.
Figure 14:
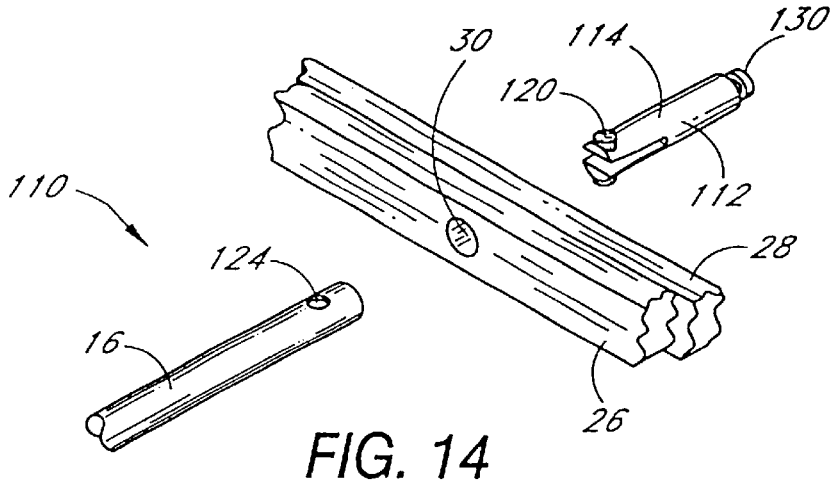
FIG. 14 is an exploded, enlarged perspective view of another preferred embodiment of a connector illustrating a connector configured to extend through two leg members or a leg member and a cross bar.
Figure 15:
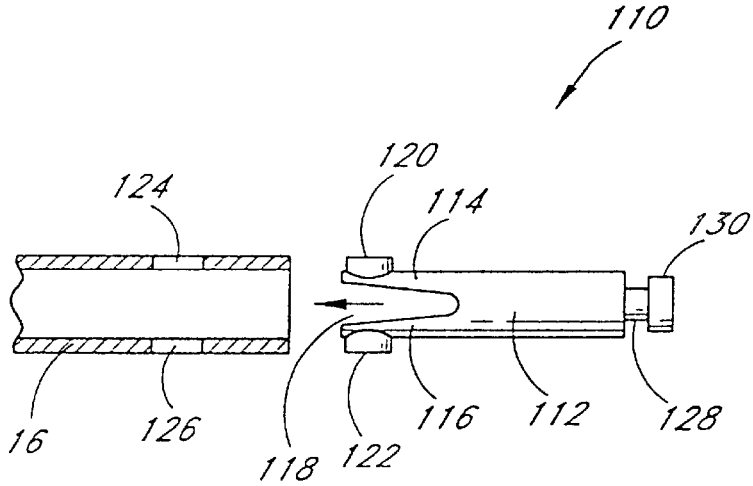
FIG. 15 is a cross sectional side view of the connector shown in FIG. 14 attached to a connecting rod, with a portion of the connecting rod cut away.

In greater detail, the legs 12 and 14 of the laundry stand 10 are preferably foldable or collapsible for purposes such as storage or transport. More preferably, the legs 12 and 14 are scissor linkages 24 which are expandable into an open configuration as shown in FIG. 1 but, as known, the scissor linkages may also be collapsed into a closed position. As seen in FIG. 1, each scissor linkage 24 includes first and second elongated members 26 and 28 which are pivotably connected near the center of the members by a connector 22. As best seen in FIGS. 4, 9 and 14, the elongated members 26 and 28 include an opening 30 located near the middle of each elongated member. In the expanded or open position, the members 26 and 28 are generally aligned at about a right angle to form a generally X-shaped configuration, but the members may also be aligned at other angles. Although not shown in the accompanying figures, in the closed position the members 26 and 28 are placed generally parallel or adjacent to each other. It will be understood that other types of legs, such as straight, curved, telescoping, etc., may be used with the laundry stand 10.

The elongated members 26 and 28 of the scissor linkages 24 are preferably between about 6 inches and 36 inches in length, and more preferably the elongated members are about 19 inches in length, but the members may also be longer or shorter. The elongated members 26 and 28 preferably have a body portion having a width of about ⅞ of an inch and legs having a length of about ½ of an inch, but the members may have any desired configuration and dimensions depending, for example, upon the type of material used to construct the members and the intended use of the laundry stand 10.

The components of the laundry stand 10 are preferably constructed from plastic, and more preferably from a thermoplastic resin such as polyvinyl chloride (PVC), but other types of plastics such as polyethylene, polypropylene or ABS may also be used. The plastic components are preferably designed to withstand temperatures of over 120° F. so that the stand does not melt or deform it when used outdoors and the plastic is preferably treated by known means to resist damage from the sun, including protection from ultraviolet (UV) and infrared radiation. Advantageously, the plastic components increase the life expectancy of the laundry stand 10 and the stand can be used both indoors and outdoors. It will be understood that the laundry stand 10 can also be constructed from other types of plastics and other materials such metals or composites. As discussed below, the stand 10 may also include components constructed of wood.

As seen in FIG. 1, scissor linkages 24 are pivotably fastened together by connectors 22 to form the first leg 12 and the second leg 14. The multiple scissor linkages 24 are interconnected by inserting a connector 22 through aligned openings 32 located near the ends of the elongated members 26 and 28. The connectors 22 thus pivotably connect the scissor linkages 24. For example, as seen in FIG. 1, the first leg 12 and second leg 14 include three interconnected scissor linkages 24 with a lower scissor linkage 25 and an upper scissor linkage 27, but the legs may have more or fewer scissor linkages. The lower ends 34 and 36 of the lowermost scissor linkages 25 include openings 32 but these openings are not used because this portion of the scissor linkage contacts a support surface and it is not connected to another scissor linkage.

Figure 16:
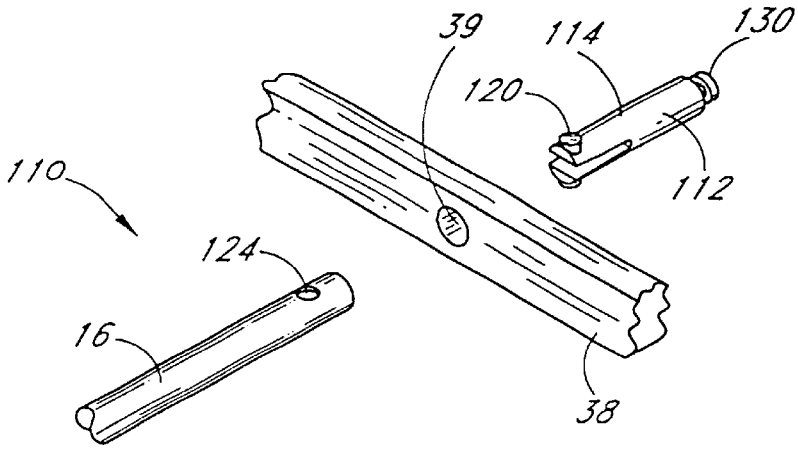
FIG. 16 is an exploded, enlarged perspective view of a portion of the connector shown in FIG. 14, illustrating a connector configured to extend through the cross bar.
Figure 17C:
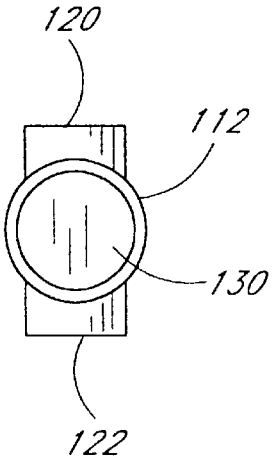
FIG. 17*c* is a right side view of the connector shown in FIG. 17*a;*
Figure 17D:
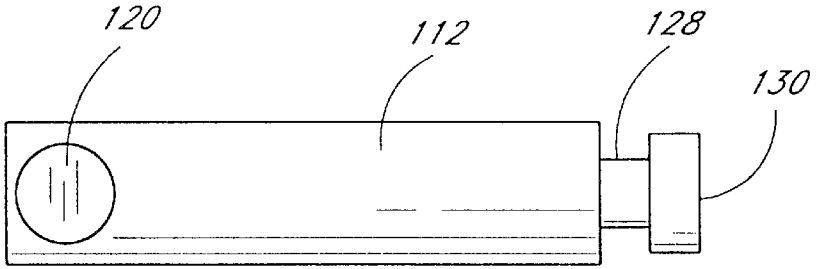
FIG. 17*d* is a top view of the body of the connector shown in FIG. 17*a;*
Figure 17A:
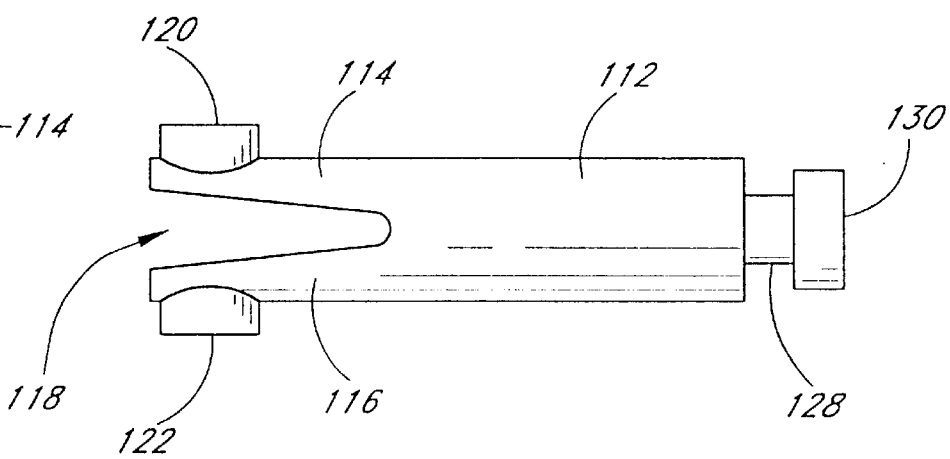
FIG. 17*a* is a front view of the body of the connector shown in FIG. 14.
Figure 17B:
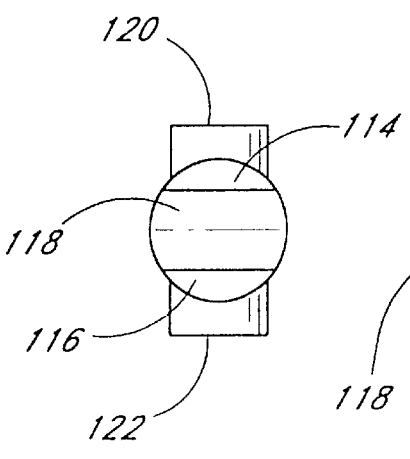
FIG. 17*b* is a left side view of the connector shown in FIG. 17*a;*
Figure 18:
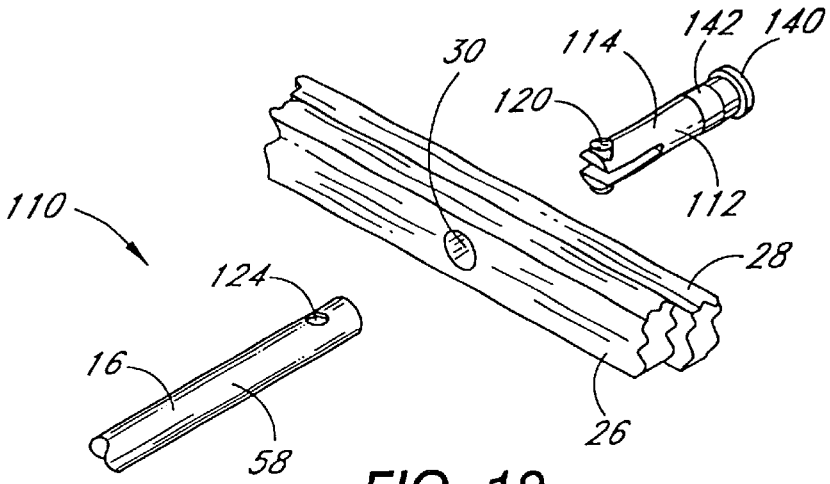
FIG. 18 is an exploded, enlarged perspective view of another preferred embodiment of a connector, illustrating a connector configured to extend through two leg members or a leg member and a cross bar.
Figure 19:
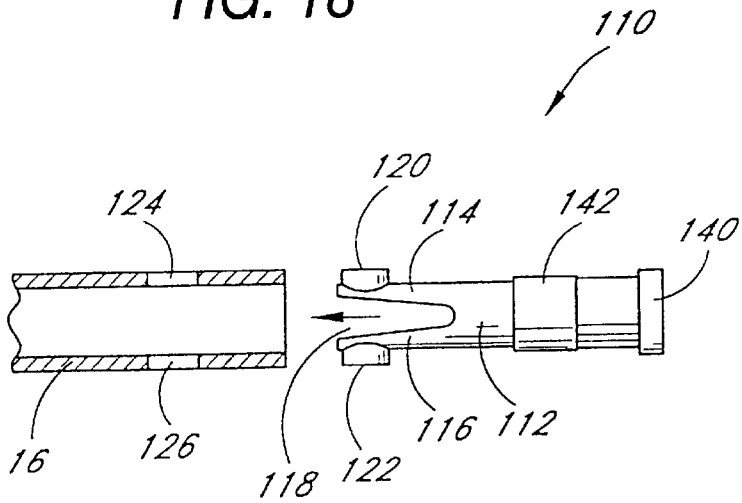
FIG. 19 is a cross sectional side view of the connector shown in FIG. 18 attached to a connecting rod, with a portion of the connecting rod cut away.
Figure 20:
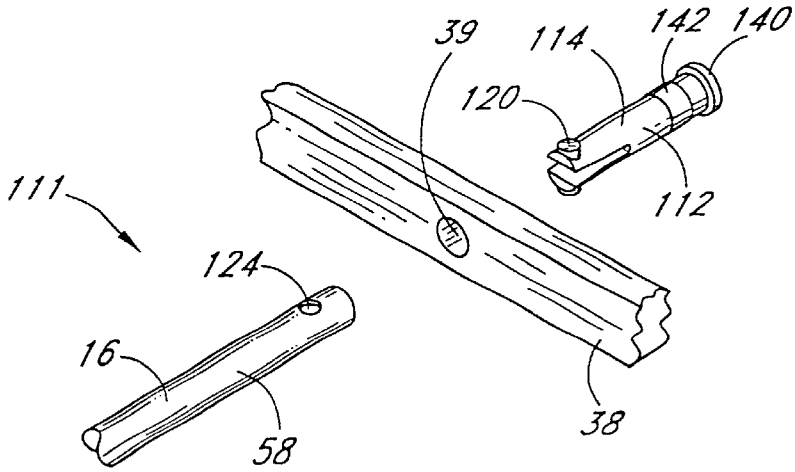
FIG. 20 is an exploded, enlarged perspective view of a portion of the connector shown in FIG. 18, illustrating a connector configured to extend through the cross bar.
Figure 21C:
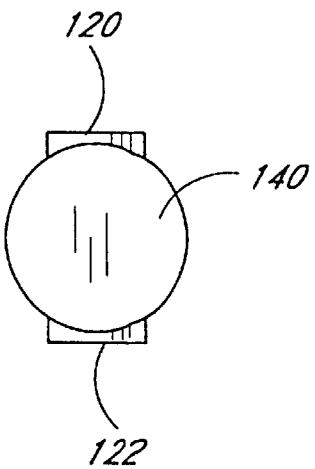
FIG. 21*c* is a right side view of the connector shown in FIG. 21*a*.
Figure 21D:
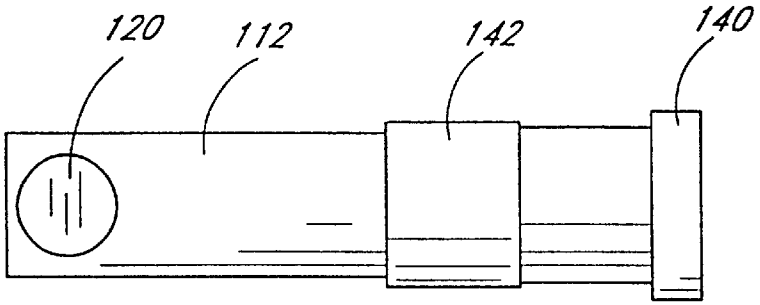
FIG. 21*d* is a top view of the body of the connector shown in FIG. 21*a*.
Figure 21A:
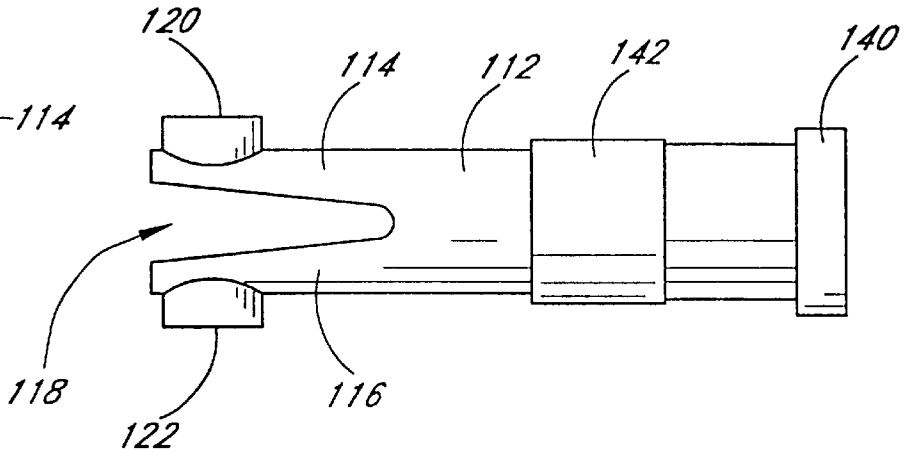
FIG. 21*a* is a front view of the body of the connector shown in FIG. 18.
Figure 21B:
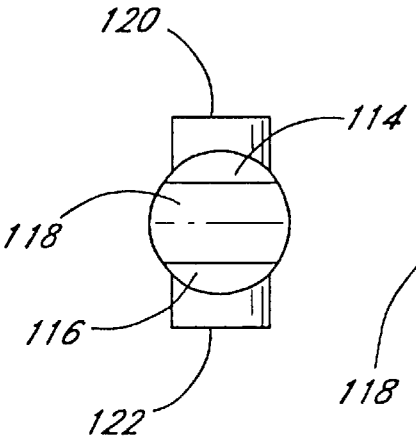
FIG. 21*b* is a left side view of the connector shown in FIG. 21*a;*

The distal ends of elongated members 26 and 28 of the uppermost scissor linkages 27 are joined by cross bars 38. The cross bars 38 are preferably about 14 inches in length and the cross bars have a generally C-shaped cross section with a body portion having a width of about ⅞ of an inch and legs have a length of about ½ of an inch, but the cross bars may have different configurations and dimensions. Each cross bar 38 preferably includes one or more openings 39 (shown in FIGS. 6, 11 and 16) which are spaced apart at a predetermined interval. More preferably, the openings 39 in the cross bar 38 attached to the first leg 12 are generally aligned with the openings in the cross bar attached to the second leg 14.

The cross bar 38, when it is connected to the distal ends of the elongated members 26 and 28, holds the scissor linkage 24 in the open position. On the other hand, when the cross bar 38 is disconnected from one or both ends of the elongated members 26 and 28, the scissor linkages 24 may collapse into a closed position.

There are several ways to connect the cross bars 38 to the distal ends of the scissor linkages 26 and 28. For example, in one embodiment, the first end 40 of the cross bar 38 may be pivotably connected to the end of the elongated member 28 of the uppermost scissor linkage 27 by a connector 22. The second end 42 of the cross bar 38 includes a downwardly extending generally U-shaped cutout section 44 configured to be placed over and in contact with connector 22 attached to the end of the elongated member 26 of the uppermost scissor linkage 27. Advantageously, the cutout section 44 has a narrower opening that is sized to snap over the piece inserted into the cutout section 44 and lock into place. In another embodiment, the cross bar 38 can include an opening rather than a cutout section 44 and the second end 42 of the cross bar can be connected by a connector 22 to the uppermost scissor linkage 27. In yet another embodiment, the distal ends 40 and 42 of cross bars 38 can include openings which are aligned with openings 32 at the ends of the linkages 26 and 28. An interlocking snap fastener, such as the fastener 48 described below, can be inserted through the aligned openings to connect the cross bar 38 to the linkages 26 and 28. In still another embodiment, the distal ends of cross bars 38 can be angled as shown in FIG. 1 to conform to the angle of inclination of the scissor linkages 26, 28, with an interlocking snap fastener 48 of the type described below passing through a hole in the edge of ends 40, 42 of linkages 26, 28.

Figure 2:
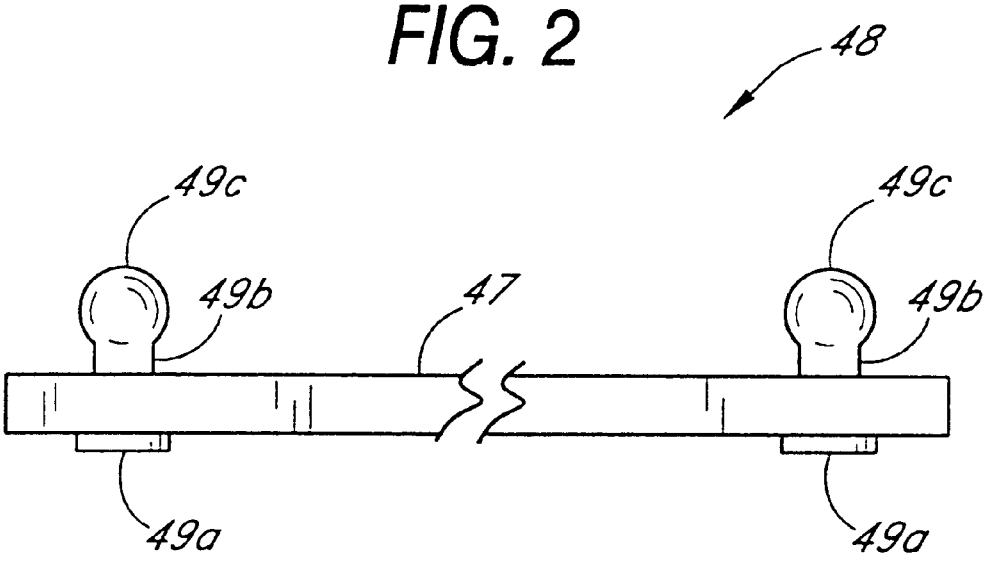
FIG. 2 is a enlarged top view along lines 2—2 of a portion of the laundry stand shown in Figure 1, illustrating the latching leg.
Figure 3:
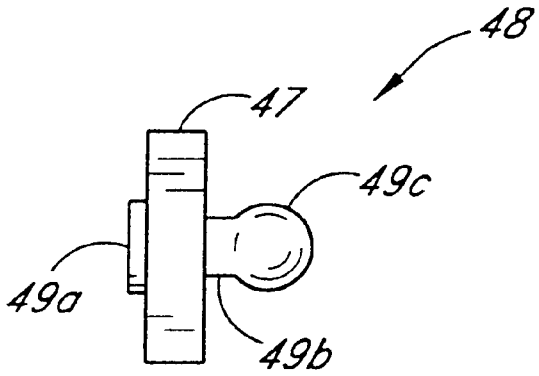
FIG. 3 is an enlarged cross sectional side view along lines 3—3 of a portion of the laundry stand FIG. 1, illustrating a portion of the latching leg.

As shown in FIGS. 1–3, the elongated members 26 and 28 of the lower scissor linkages 25 are interconnected by a latching leg 46 to further secure the legs in the desired position. In particular, the distal ends of the latching leg 46 are connected to the elongated members 26 and 28 of the scissor linkage 25 by a fastener 48. As best seen in FIGS. 2–3, the fastener 48 includes a body 49*b* with a head 49*a* at one end and an enlarged projection or bulb 49*c* located at the other end. The fastener 48 is sized and configured to allow the body 49*b* and bulb 49*c* to be inserted through an opening in the latching leg 46 and a corresponding opening in the elongated members 26 or 28, but the head 49*a* is sized larger than the openings to prevent the fastener 48 from passing through the openings. Because the bulb 49*c* is sized slightly larger than the openings, the latching leg 46 is snap connected to the cross members 26 and 28 of the scissor linkage 25 to securely lock the leg 12 into position. It will be understood that any type of desired fastener including, for example, the fasteners used to connect cross bars 38 and elongated members 26, 28 (and vice versa), threaded fasteners such as bolts and screws, etc. may be used to connect the latching leg 46 to the legs 12 and/or 14. Additionally, fasteners could be integrally formed as part of the latching leg 46.

The latching leg 46 is desirably about 8 inches in length, and it has a generally rectangular cross section with a width of about ¾ of an inch and a thickness of about ⅜ of an inch, but the leg may have any desired size and shape. As shown in FIG. 1, the latching leg 46 is attached about 4 inches above the intersection of the elongated members 26 and 28 of the lowermost scissor linkage 25 of the first leg 12, but the latching leg may be attached in any desired portion and to any of the scissor linkages. It will be appreciated that the latching leg 47 may be attached to either or both legs 12 and 14, but the latching leg is not required.

The connecting rods 16 which interconnect the first leg 12 and the second leg 14 are preferably between about 12 inches and 60 inches in length and more preferably about 29 inches in length, but the connecting rods may be longer or shorter. The connecting rods 16 are preferably plastic tubes with walls about 1/16 of an inch thick and the rods have an outside diameter of about ⅜ of an inch, but the rods may have any desired configuration and size. The connecting rods 16 are preferably hollow tubes for decreased weight, but the rods may also be solid for increased strength. Additionally, the rods 16 have a generally smooth cylindrical exterior surface to prevent laundry from snagging or catching on the rods. Alternatively, the rods 16 may have any desired shape, such as square or rectangular, and the rods may be constructed from other materials such as wood or metal. The rods 16 may also include a coating or layer of material, for example, to help prevent laundry from catching or snagging on the rods.

The components of the laundry stand 10, including the connecting rods 16, elongated members 26 and 28, latching leg 46 and connectors 22, desirably fit into a small bag or enclosure for shipping and storage. For example, if the stand 10 is unassembled, the components will fit into a bag having a length of about a 30 inch length and a width of about 5 inches and about a 3 inch height. Additionally, if the stand 10 is partially assembled with the scissor linkages 24 interconnected to form the legs 12 and 14, the components of the stand will fit into a bag having a length of about 30 inches, a width of about 20 inches and a height of about 5 inches. Because the unassembled or partially assembled stand fits within a small, compact bag or enclosure, this significantly reduces shipping, transportation and storage costs.

The connectors 22 allow the connecting rods 16 to connect the legs 12 and 14 in a variety of different locations. As seen in FIG. 1, for example, an exemplary connecting rods 16 are shown on the front edge of the lower portion 20 of the stand and four connecting rods extend across the upper portion 18 of the stand, but any number of connecting rods may be positioned between any generally aligned connectors 22. Advantageously, this allows laundry to be supported in a variety of different locations and, for example, at different distance from the support surface.

Figure 5:
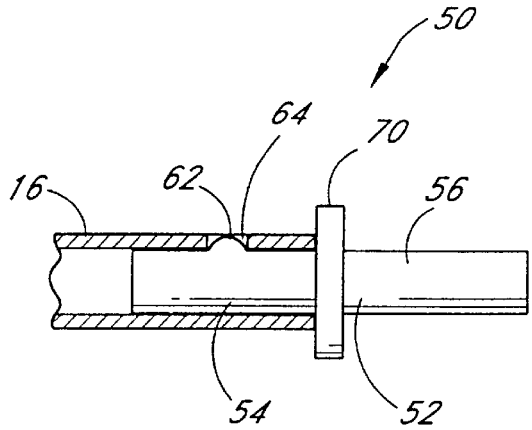
FIG. 5 is a cross sectional side view of the connector shown in FIG. 4 attached to a connecting rod, with a portion of the connecting rod cut away.
Figure 6:
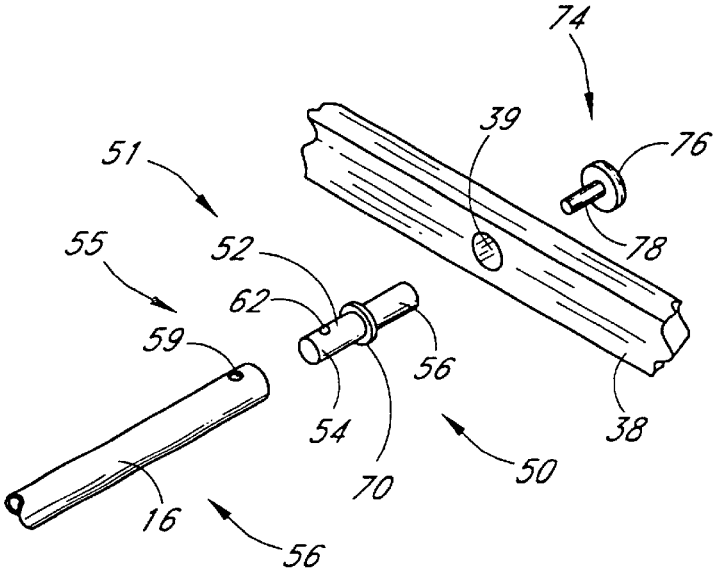
FIG. 6 is an exploded, enlarged perspective view of the connector shown in FIG. 4, illustrating connector configured to extend through the cross bar.
Figures 7A, 7B, 7C:
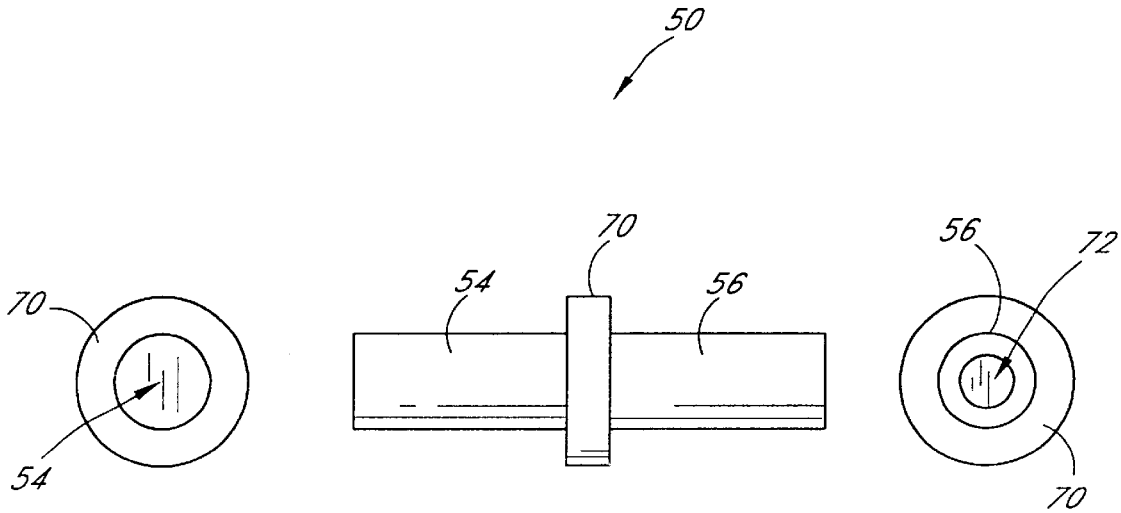
FIG. 7*a* is a front view of the body of the connector shown in FIG. 4.
FIG. 7*b* is a side of the body of the connector shown in FIG. 7*a;*
FIG. 7*c* is a back view of the body of the connector shown in FIG. 7*a;*
Figures 8A, 8B, 8C:
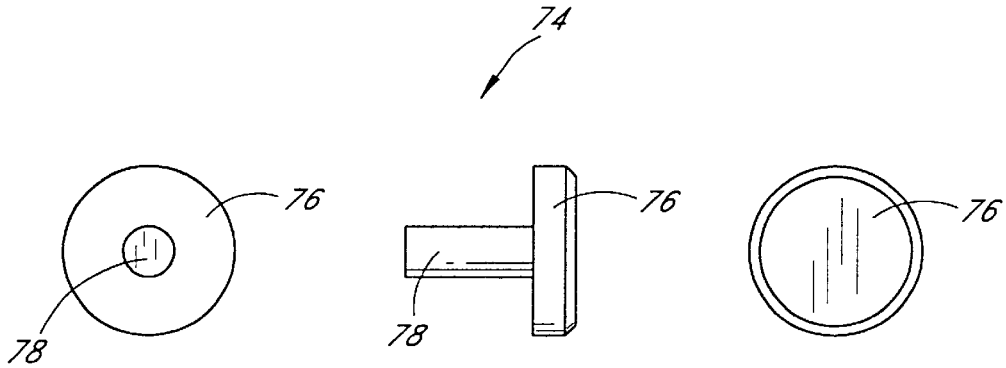
FIG. 8*a* is a front view of the pin of the connector shown in FIG. 4.
FIG. 8*b* is a side view of the pin of the connector shown in FIG. 8*a;*
FIG. 8*c* is a back view of the pin of the connector shown in FIG. 8*a;*

As seen in FIGS. 4–6, a preferred embodiment of the connector 22 used in conjunction with the laundry stand 10 is a connector 50. The connector 50 includes an elongated body 52 with a first end 54 and a second end 56. The first end 54 is sized and configured to be inserted into the end 58 of the connecting rod 16. The connecting rod 16 and connector 50 are preferably interconnected by a friction or interference fit and, more preferably, a fastener 60 is used to securely connect the rod and the connector. The fastener 60, comprises a projection or protuberance 62 which extends radially outwardly from the connector 50 and the end 58 of the rod 16 includes an opening or detent 64 configured to receive the protuberance. The positioning of the protuberance 62 in the opening 64 securely connects or locks the rod 16 to the connector 50, but it will be appreciated that the rod and connector may be attached by any known means, such as bolts, screws, adhesives, etc. Advantageously, while the fastener 60 securely attaches the connector 50 and the rod 16, the fastener is releasable to permit disassembly of the laundry stand 10.

The connector 50 also has a second end 56 which is configured to be inserted through aligned openings 30 formed in a pair of adjacent elongated members 26 and 28 (as seen in FIG. 4) to form a scissor linkage; or the connector can be inserted through aligned openings 32 located near the distal ends of a pair of elongated members to interconnect a pair of scissor linkages (as seen in FIG. 1). The second end 36 of the connector 50 may also be configured to extend through an opening 32 at a distal end of an elongated member 16 and through an aligned opening 51 in the cross bar 38 (as seen in the upper portion of FIG. 1). Alternatively, the second end 56 of the connector 50 may be configured to extend through an opening 39 in a cross bar 38 (as seen in FIG. 6).

The first end 54 of the connector 50 preferably has a length of about ⅝ of an inch and an outside diameter of about ¼ of an inch, and this first end is sized and configured to be inserted into the end 58 of the connecting rod 16. The second end 56 of the connector 50 has a length of about ¾ of an inch and an outside diameter of about ¼ of an inch which is configured to be inserted through an aligned pair of openings 30, 32 or single opening 39 as discussed above. A flange or collar 70 with an outside diameter of about ½ of an inch divides the connector 50 into the first end 54 and second end 56. The collar 70 advantageously provides a surface which may contact the outer surface of the elongated members 26 or 28 and the end 54 of the rod 16. Preferably the flange or collar 70 extends around the entire periphery of the connector 22, but need not do so. The flange 70 is advantageously configured to prevent passage of the flange through openings 30, 32 or 39.

As best seen in FIGS. 4, 6, 7 and 8, the second end 56 of the connector 50 includes an opening 72 configured to receive a locking device such as a fastener 74 with a head 76 and an elongated shaft 78. The opening 72 has a diameter of about ⅛ of an inch and it extends approximately the entire length of the second end 56 of the body 52. The head 76 of the fastener 74 has an outside diameter of about ½ of an inch and the shaft 78 is about ⅛ of an inch in diameter and about ⅜ of an inch in length, but the fastener 74 can have any desired dimensions. The head 76 is preferably sized larger than the opening 30, 32, 39 in the elongated members 26, 28 or cross bar 38 to prevent the fastener 74 from passing through the openings. Alternatively, the head 76 could be shaped differently than the opening so that the head would not normally fit through the opening.

Whether it is the size or the shape of the head 76, the head is configured so that the head does not readily pass through the opening 30, 32, 39 and instead restrains movement of the connector 22. The shaft 78 is configured to be press fit into the opening 72 in the second end 64 of the connector 50, but the elongated shaft of the fastener 74 could be configured to fit over the second end 56 of the connector 50. The fastener 74 allows the connector 50 to be fastened to the pair of elongated members 26 and 28 or an elongated member and cross bar 38 combination, and restrains removal of the members 26 and 28.

Referring to FIG. 4, the second end 56 of the connector 50 is inserted through the opening 30 in members 26 and 28. The shoulder or collar 70 abuts the member 26 to limit motion of the connector 50. The shaft 78 of fastener 74 is inserted into the opening 72 and pressed until it locks, preferably with fastener head 76 abutting the side of member 28, and with collar 70 abutting the opposing side of the member 26, 28 or 38 through which the second end 56 extends. The press fit locks the connector 50 to the members 26 and 28. The end 58 of a connecting rod 16 is then attached to the first end 54 of the connector 50 and the fastener 74 securely locks the connecting rod to the fastener.

The connector 50 may also be configured to extend through a single elongated member 26 or 28, or cross bar 38 as shown in the accompanying FIG. 6. In this embodiment, the second end 56 of the connector 50 has a length of about ½ of an inch or less, depending upon the thickness of the members 26, 28, or 38. This allows the connector 50 to be attached in any desired location to the members 26, 28 and 38. As seen in FIG. 1, for example, fasteners 50 are used to attach two connecting rods 16 to the cross bars 38. It will be appreciated that the fasteners 50 may be placed in any desired location and any number of connecting rods 16 may be used in conjunction with the fasteners.

Thus, the connector 50 includes two opposing ends 54 and 56, preferably with the same outside diameter, one of which mates with connecting rod 16 with the other end extending through a member of one of the scissor legs 12, 14 to engage a fastener 74 that cooperates with flange 70 to prevent removal of the connector from the engaged scissor leg 12, 14.

In a preferred embodiment of constructing the laundry stand, a pair of elongated members 26 and 28 are positioned with the central openings 30 generally aligned. The second end 56 of the elongated body 52 of the connector 50 is inserted through the aligned openings 30 and a fastener 74 is inserted into the opening 72 in the end of the connector to pivotably connect the elongated members 26 and 28 into a scissor linkage 24. Additional scissor linkages 24 are constructed in a similar manner and the scissor linkages are interconnected by additional connectors 50 to form the first leg 12 and second leg 14. The legs 12 and 14 are constructed with the first ends 54 of the connectors 22 pointed in the same direction, and the legs 12 and 14 are positioned with the connectors generally aligned. Cross bars 38 are then attached to the upper portion 18 of the legs 12 and 14 to secure the legs in an open position, and the connecting rods 16 are attached to the first ends 54 of the connectors 50 to connect the first and second legs to form the laundry stand 10.

A disassembled or partially assembled laundry stand can be placed into a small, lightweight bundle for shipping. Advantageously, all parts can be shipped in an unassembled stated. But if desired, the scissor legs 12 and 14 could be assembled and placed with the remaining parts unassembled, for shipping.

It will also be understood that the connector 22 may have other shapes and configurations. For example, the connector 50 may include an end 54 which fits inside the connecting rod 16, but the connector could also have a cavity which fits around the outside of connecting rod 16, with the locking protrusion 62 extending inward instead of outward as shown in FIGS. 4–6. Alternatively, the protrusion 56 could be formed on connecting rod 16 with the engaging aperture or recess being formed on or in one end of connector 22. The press fit of the shaft 78 of the fastener 74 into the opening 72 of connector 22 could also be replaced by an engaging and locking protrusion 62 on either the shaft 78 or end 56, and a recess 64 being formed in either the shaft 78 or end 56. Further, the shaft 78 of fastener 74 is shown as being press fit into a cavity in end 56 of connector 50, but the fastener 74 could be formed to have a hollow end 78 that fits around end 64 of connector 55.

It will be understood that the fastener 74 can all take various forms and shapes. For example, one additional configuration is that shaft 78 could be threaded and cooperate with mating threads on the interior cavity of end 64 of connector 22. Further, the exterior of the end 64 could be threaded and shaft 78 could have internal threads configured to engage the exterior threads on shaft 78.

In a further embodiment of the laundry stand 10, the collar or flange 70 could be omitted so that the connector 22 extends through the hole or opening in the members of one of the scissor ends 12, 14 and is restrained from being pulled toward the opposing scissor member by head 76 of fastener 74, but is not restrained from moving in the opposite direction along the axis of the connecting rod 16.

There is thus advantageously provided a connector 50 for use with a laundry stand 10 in which the connector has a body 52 with a first end 54 and a second end 56. A cavity 72 is in one of the ends, and an outwardly extending flange is placed between the ends. A radially extending protrusion 62 is placed adjacent a distal end of one of the first and second ends. Preferably the first and second ends are cylindrical and of substantially the same diameter. Further, the flange 70 preferably comprises an annular flange and the protrusion 62 extends radially outward from a portion of the first end 54 which is not tubular. There is advantageously a fastener 74 with an enlarged head 76, and with a shaft 78 configured to be press fit into the cavity 72 which is located in the second end 56 of the connector. The second end 56 of the connector body 52 is inserted through an opening in at least one member of a laundry stand 10, and the opening is configured so neither the flange 70 nor the enlarged head 76 of the fastener 74 readily pass through the opening when the shaft of the fastener is inserted into the cavity. Preferably, a connecting rod 16 engages the first end 54 of the connector 50 and the protrusion 62 restrains relative motion of the rod and connector. The protrusion 62 and recess 64 restrain disengagement of the rod 16 and engaged connector 50.

The improved laundry stand 10 also comprises a rack with opposing scissor ends and connector rods 16 extending between the ends, in which there are first means for connecting a first end of the connector 22 to a distal end of the connecting rod and restraining relative motion between, or removal of, the connector and rod after they are connected. There is also provided a second means for connecting a second end of the connector 22 to one of the scissor ends and restraining removal of the second means from the scissor end after they are connected. Advantageously, the first means comprises a cylindrical member having a radial protrusion at a distal end of the member, and the second means comprises a tubular member into which, in the installed configuration, is press fit a mating shaft having an enlarged distal end that remains outside of the tubular member when assembled to the scissor end. As discussed above, other fastening mechanisms can be used for the second means, including threaded connections, pins, stakes, etc., which prevent removal of the connector from the connected members of the laundry stand. The first means is preferably connected to one connecting rod of the laundry stand and the second means is connected to one scissor end of the rack.

There is also advantageously provided a kit for constructing a laundry stand. The kit includes a plurality of connectors 22, each of the connectors having a body with a first annular portion sized to mate with a correspondingly shaped end of a rod 16 of the laundry stand 10. The connectors 22 also have a second annular portion sized to be inserted through an opening in at least one member of the laundry stand 10. Scissor linkages are formed from a plurality of pairs of elongated members having aligned openings through which the connectors 22 can be inserted to pivotably connect the pairs of members to form the scissor linkages. The ends of the scissor linkages have openings through which the connectors can be inserted to join two scissor linkages. At least two scissor linkages are joined to form a first leg, and at least two scissor linkages being joined to form a second leg. A plurality of connecting rods are configured to interconnect the first leg and the second leg by connecting to the connectors.

A plurality of fasteners prevent removal of the connectors. The fasteners advantageously have a shaft configured to engage the second end of the connectors, with an enlarged head on the shaft being configured to restrain passage through the holes. Similarly, there is advantageously a protrusion on one of the rod or connector and a recess on the other of the rod or connector, with the protrusion and recess being configured and located so that when assembled the protrusion enters the recess to restrain relative motion between the connector and rod. This also restrains removal of the engaged rod and connector. Preferably, the kit further includes a cross bar configured to be connected to distal ends of a scissor linkage on one of the legs. This helps to prevent the laundry stand from collapsing, as does a latching leg configured to be attached to two members of a scissor linkage—which is also preferably included in the kit.

Another aspect of this invention includes a method for constructing a laundry stand 10. The method includes the steps of connecting a plurality of pairs of elongated members having aligned holes by placing connectors through the holes to pivotably connect the pairs of members and form scissor linkages. Ends of the scissor linkages are connected by placing connectors through holes in the ends to join two adjacent scissor linkages. At least two scissor linkages are joined to form a first leg, and at least two scissor linkages being joined to form a second, opposing leg. A plurality of the connectors 22 on one leg have a free end extending toward the opposing leg and are alignable with a free end of a connector on the opposing leg. The connectors 22 are fastened to the joined members to allow rotation of the members and prevent removal of the connectors.

Advantageously, connectors 22 on opposing legs are aligned, and a rod 16 is fastened between a plurality of pairs of the aligned free ends of the connectors. The rods 16 are preferably fastened by having them engage a mating surface of the connector. Preferably the connector 22 has a cylindrical end that fits inside a hollow end of the rod. Desirably, there is a recess on an end of the rod 16 or connector 22 with a protrusion on the other of the rod or connector to restrain the rod from being disengaged. Further, the connectors 22 are fastened to the joined members by placing the joined members between a flange on the connector and a head of a fastener connected to connector, where the flange and head are too large to pass through the holes in the members through which the connector is inserted. This prevents removal of the connector from the scissor legs.

As shown in FIGS. 9–13, another preferred embodiment of the connector 22 used in conjunction with the laundry stand 10 is the connector 80. The connector 80 includes a body portion 82 with a generally cylindrical configuration. The body portion 82 includes a first end 84 with an opening 86 configured to receive the end 58 of connecting rod 16. The connector 80 also has a second end 88 configured to be inserted through aligned central openings 30 formed in a pair of adjacent elongated members 26, 28 (as seen in FIG. 9); or aligned openings 32 near the ends of a pair of elongated members (as shown in FIG. 1). The second end 88 may also be configured to extend through an opening 32 at an end of an elongated member 16 and an opening 39 in the cross bar 38 (as seen in the upper portion of FIG. 1).

The first end 84 of the connector 80 preferably has a length of about ⅝ of an inch, an outside diameter of about ½ of an inch, and an inside diameter of about ⅜ of an inch. Located on the inner surface of the opening 86 in the first end 84 of the body portion 82 are a plurality of inwardly extending ribs or projections 90 (as seen in FIGS. 9, 10, 11 and 12*a*). The ribs 90 have a height in the range of about 1/32 to about 1/16 of an inch and the ribs are configured to grippingly engage the end 58 of the connecting rod 16. More preferably, the ribs 66 and the end 58 of the connecting rod 16 have an interference or press fit to hold the components securely, but releasably, in the desired position.

The second end 88 of the connector 80 has a length and shape which is configured to be inserted through an aligned pair of openings 30, 32 and 39 as discussed above. The second end 88 preferably has a length of about ¾ of an inch and an outside diameter of about ¼ of an inch—which is smaller than the outside diameter of the first end 84 of the connector 80 to create an abutment surface 92. The abutment surface 92 advantageously prevents the entire connector 80 from being inserted through the openings 30, 32 or 39 in the elongated members 26, 28 and/or cross member 38.

Figure 13A:
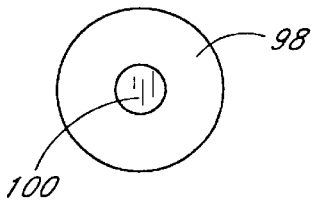
FIG. 13*a* is a front view of the pin of the connector shown in FIG. 9.
Figure 13B:
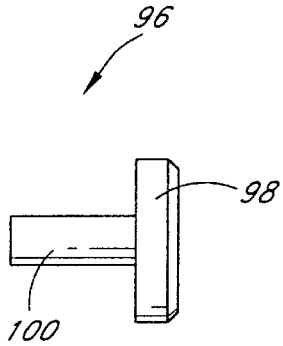
FIG. 13*b* is a side view of the pin of the connector shown in FIG. 13*a;*
Figure 13C:
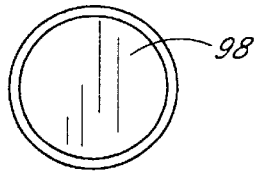
FIG. 13*c* is a back view of the pin of the connector shown in FIG. 13*a;*

The second end 88 of the connector 22 includes an opening 94 (shown in FIG. 12*c*) configured to receive a locking device such as a fastener 96 with a head 98 and an elongated shaft 100 (best shown in FIGS. 13*a*–13*c*). The opening 94 has a diameter of about ⅛ of an inch and it extends approximately the entire length of the second end 88 of the body 82. The head 98 of the fastener 96 has an outside diameter of about ½ of an inch and the shaft 100 is about ⅛ of an inch in diameter and about ⅜ of an inch in length but the fastener 96 can have any desired dimensions. The head 98 is preferably sized larger than the openings 30, 32 or 39 in the elongated members 26, 28 or cross bar 38 to prevent the fastener 96 from passing through the openings. The shaft 100 is configured to be press fit into the opening 94 in the second end 88 of the connector 80, but the elongated shaft of the fastener 96 could be configured to fit over the second end of the connector. The fastener 96 allows the connector 80 to be fastened to the pair of elongated members 26, 28 or an elongated member and cross bar 38 combination.

Figure 11:
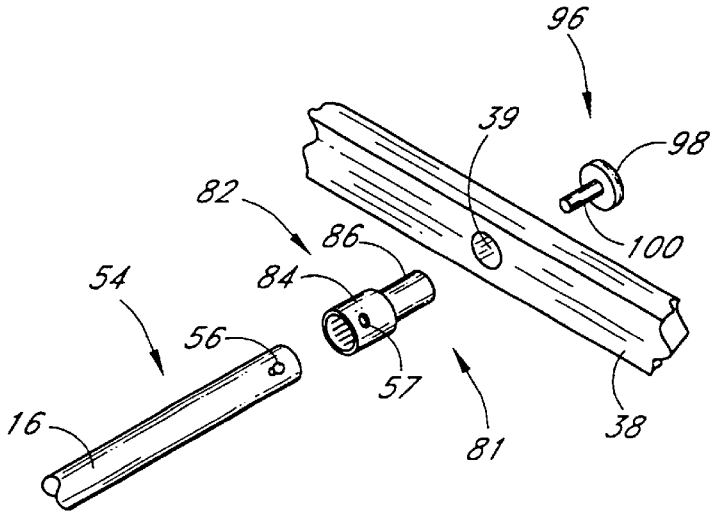
FIG. 11 is an exploded, enlarged perspective view of a portion of the connector shown in FIG. 9, illustrating a connector configured to extend through the cross bar.
Figure 12A:
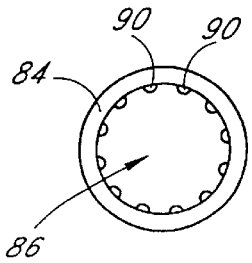
FIG. 12*a* is a front view of the body of the connector shown in FIG. 9.
Figure 12B:
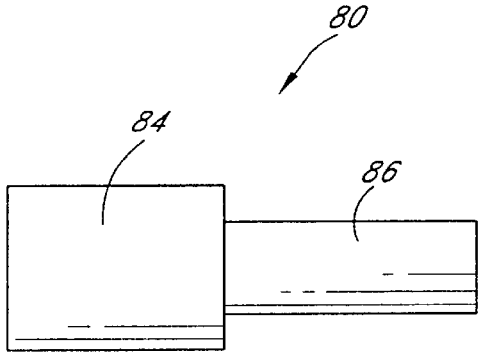
FIG. 12*b* is a side view of the body of the connector shown in FIG. 12*a;*
Figure 12C:
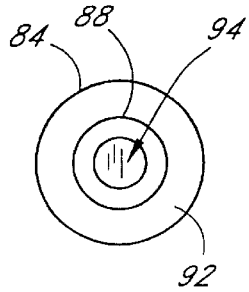
FIG. 12*c* is a back view of the body of the connector shown in FIG. 12*a;*

Referring to FIGS. 9 and 11, the second end 88 is inserted through one of the openings 30, 32 or 39 in members 26, 28, or 38. The abutment surface 92 abuts the members 26, 28 or 38 to limit motion of the connector 80. The shaft 100 of fastener 96 is inserted into the opening 94 and pressed until it locks, preferably with fastener head 98 abutting one side of member 26, 28 or 38, and with abutment surface 92 abutting the opposing side of the member 26, 28 or 38 through which the second end 88 extends. The press fit locks the connector 80 to the member 26, 28 or 38. The end 58 of a rod 16 is then inserted into the opening 86 of connector 80. A plurality of such connections results in the laundry rack 10. As shown in FIG. 11, the connector 80 may also be configured to extend through only a single elongated member 26, 28 or cross bar 38, 47.

The connector 80 preferably includes a fastener 102 configured to lock the connecting rod 16 to the connector. The fastener 102 includes a projection or protuberance 104 which extends outwardly from the end 58 of the connecting rod 16 and the connector 80 includes an opening or detent 106 configured to receive the protuberance. The positioning of the protuberance 104 in the opening 106 securely connects the rod 16 to the connector 80, but it will be appreciated that the rod and connector may be attached in various means. For example, the rod 16 and connector 80 may be attached be a press or interference fit by inserting the end 58 of the rod into the opening 86 in the connector. The distal end 58 of the rod 16 contain a tapered section to facilitate attachment of the rod to the connector 80, but the rod does not have to be tapered. It will be appreciated that the rod 16 may be attached to the connector 22 by other means, such as bolts, screws, adhesives, etc.

In preferred embodiment of constructing the laundry stand shown in FIG. 9, a pair of elongated members 26 and 28 are positioned with the central openings 30 generally aligned. The body portion 82 of the connector 80 is inserted through the aligned openings 30 and a fastener 96 is inserted into the opening 94 in the end of the connector to pivotably connect the elongated members 26 and 28 into a scissor linkage 24. Similar to that described above, additional scissor linkages 24 may be constructed in a similar manner and the scissor linkages may be interconnected by additional connectors 80 to form the first leg 12 and second leg 14. The legs 12 and 14 are preferably constructed with the first ends 84 of the connectors 80 pointed in the same direction, and the legs 12 and 14 are positioned with the connectors generally aligned. The cross bars 38 are then attached to the upper portion 18 of the legs 12 and 14 to secure the legs in an open position, and one or more connecting rods 16 are attached to the connectors 80 to connect the first and second legs to form the laundry stand 10.

In another preferred embodiment of the connector 22, as shown in FIGS. 14–17, the connector 110 may include a body 112 with a generally cylindrical configuration. Longitudinally extending from one end of the body 112 is a pair of legs 114 and 116 which are separated by a gap 118. The outer surfaces of the legs 114 and 116 are preferably cylindrical and generally aligned with the outer surface of the body 112. Radially outwardly extending from each of the legs 114 and 116 are projections 120 and 122, respectively, which are sized and configured to be inserted into holes or recesses 124 and 126 in the end 58 of the rod 16.

Longitudinally extending from the other end of the body 112 is a shaft 128 with a disk 130 mounted to the end of the shaft. The shaft 128 and disk 130 are advantageously configured to fit into the U-shaped cut-out section 44 and the end of cross bar 38 so that the cross bar can be attached the leg 12 or 14. It will be understood that the cross bar 38 may be attached to the connector 110 in any known manner, including those previously described. The connector 110 of course does not require the shaft 128 or disk 130.

The connector 110 shown in FIGS. 14–17 are preferably constructed from a resilient material such as PVC, polyethylene or polypropylene, but any material, whether or not plastic, with suitable characteristics may be used to construct the connector. In particular, the legs 114 and 116 are preferably resilient so that they can be inserted into the end 58 of a connecting rod 16. The gap 118 between the legs 114 and 116 is at least large enough to allow the legs to sufficiently deflect to allow the legs to be inserted into the rod 16. The connector 110 and rod 16 are then positioned to insert the projections 120 and 122 with the recesses 124 and 126 respectively. Because the connector 110 is constructed of a resilient material, the projections 120 and 122 snap into the recesses 124 and 126 to securely connect the rod 16 to the connector. In order to detach the connector 110 from the rod 16, the projections 120 and 122 must be displaced from the recesses 122 and 124 and the connector removed from the rod. Advantageously, the connector 110 creates a very secure connection of the rod and the connector. Alternatively, in another preferred embodiment not shown in the accompanying figures, the end 58 of the rod 16 may be inserted into an opening between legs 114 and 116 and the projections 120 and 122 may be inwardly extending to resiliently engage the recesses 124 and 126 in the rod.

As shown in FIGS. 18–21, another preferred embodiment of the connector 22 includes a body 112 with a generally circular configuration. One end of the connector 22 includes a pair of legs 114 and 116 which are separated by a gap 118. Projections 120 and 122 are positioned near the ends of the legs 114 and 116, respectively, and the projections are sized and configured to be inserted into holes or recesses 124 and 126 in the end 58 of the rod 16. It will be understood that the connector 22 may include any number of projections and these projections may be inserted into any desired hole or recess. For example, the connector 22 may include one or more projections which may be inserted into a single hole or the connector may include a single projection which may be inserted into a plurality of holes.

The other end of the connector 22 includes an outwardly extending flange 140. The flange 140 is preferably generally circular and sized to prevent the connector from passing through elongated members 26 and 28 or cross bar 38. The connector 22 may also include an enlarged portion 142 which may be placed in any desired position along the length of the body 112 of the connector. The enlarged portion 142 is preferably generally circular with an outer diameter generally equal to the inside diameter of the opening 30 in the elongated members 26 and 28 or opening 39 in the cross bar so that the connector is press-fit into the opening. This enlarged portion 142 helps prevent the unintended removal of the connector 22 from the elongated members 26 and 28 or cross bar 38.

Although this invention has been described in terms of a certain preferred embodiment, other embodiments apparent to those of ordinary skill in the art are also within the scope of this invention. Accordingly, the scope of the invention is intended to be defined only by the claims which follow.

What is claimed is:

1. A kit for constructing a stand to support laundry, comprising:

a plurality of connectors, each of the connectors having a first end with a larger outside diameter than a second end, the second end having a recess along a longitudinal axis with the recess being sized to receive a shaft of a fastener;

a plurality of pairs of elongated members, each pair of members having aligned holes through which the connectors can be inserted to pivotably connect the pair of members to form a plurality of scissor linkages, the ends of each pair of scissor linkages having corresponding holes through which the connectors can be inserted to join two scissor linkages, at least two scissor linkages being joinable to form a first leg, and at least two scissor linkages being joinable to form a second leg, the shaft of the fastener engaging the recess with the fastener having a head larger than the hole in order to prevent removal of the connector from the members; and a plurality of connecting rods configured to be fastened to one end of the connectors to interconnect the first leg and the second leg.

2. The kit of claim 1, further comprising a cross bar configured to be pivotably connected to distal ends of a pair of members forming a scissor linkage.

3. The kit of claim 1, wherein one of the connectors or the connecting rods has a protrusion and the other of the connectors or the connecting rods has a correspondingly located recess so the protrusion and recess engage to fasten the rods to the connectors.

4. The kit as defined in claim 3, wherein the protrusion is on the connecting rod.

5. The kit as defined in claim 3, wherein the protrusion is on the connector.

6. A kit for constructing a stand to support laundry, comprising:

a plurality of connectors, each of the connectors having a first end with a larger outside diameter than a second end;

a plurality of pairs of elongated members, each pair of members having aligned holes through which the connectors can be inserted to pivotably connect the pair of members to form a plurality of scissor linkages, the ends of each pair of scissor linkages having corresponding holes through which the connectors can be inserted to join two scissor linkages, at least two scissor linkages being joinable to form a first leg, and at least two scissor linkages being joinable to form a second leg;

a plurality of connecting rods configured to be fastened to one end of the connectors to interconnect the first leg and the second leg; and a plurality of inwardly extending ribs on an inner surface of an opening in the first end of the connectors sized relative to the rods to form an interference fit with an outside of an end of the rods.

7. A stand for supporting laundry, the stand having collapsible legs joined at their middle and at their ends, comprising:

a collapsible first leg including a plurality of elongated members pivotably connected at a middle part and at least at some joined ends of the members of the first leg, the first leg having a first distal end and a second distal end;

a collapsible second leg including a plurality of elongated members pivotably connected at a middle point and at least at some joined ends of the elongated members of the second leg, the second leg having a first distal end and a second distal end;

connectors attached to the first leg, each of the connectors having a first end configured to be fastened to a connecting rod and a second end configured to be inserted through one or more openings in the first leg;

connectors attached to the second leg, each of the connectors having a first end configured to be fastened to a connecting rod and a second end configured to be inserted through one or more openings in the second leg;

one or more connecting rods having opposing ends fastened to the first end of the connectors in the first and second legs to interconnect the first leg and second leg; and wherein a plurality of the rods and connectors to be fastened together have correspondingly located projections and detents that cooperatively engage to fasten the rods and the connectors together.

8. A stand as defined in claim 7, further comprising:

a first cross member attached to the first distal end and second distal end of the elongated members of the first leg; and a second cross member attached to the first distal end and second distal end of the elongated members of the second leg.

9. A stand as defined in claim 7, further comprising a plurality of fasteners having a shaft configured to engage the second end of the connectors, the fasteners having a head configured to prevent removal of the connectors from one of the legs.

10. A stand a defined in claim 9, further comprising a first projection mounted to the first end of each of a plurality of the connectors, the first projection configured and located to engage a recess in the connecting rod engaging the connector, wherein the first end of the connectors is configured to resiliently urge the first projection to engage the recess.

11. A laundry stand, comprising:

two or more pairs of elongated members, each pair of elongated members having an aligned central opening through which a connector can be inserted to pivotably connect the pair of members to form a scissor linkage, the ends of each scissor linkage having corresponding holes through which connectors can be inserted to join two scissor linkages, at least two scissor linkages being joinable to form a first leg, and at least two scissor linkages being joinable to form a second leg;

a plurality of connecting rods; and fastening means for fastening the elongated members to form the first leg and the second leg, and connector means for fastening the connecting rods to the first leg and the second leg, and retaining means for preventing removal of the connector means from the first and second leg.

12. A laundry stand as defined in claim 11, wherein the connector means comprises a pair of opposing protrusions on each of a plurality of connectors, the protrusions being resiliently mounted and located to resiliently engage correspondingly located recesses in an end of the connecting rod fastened to each of the plurality of connectors.

13. A method of assembling a stand for supporting laundry, comprising:

providing a plurality of elongated members and a plurality of connectors, each of the connectors having a first end with a larger outside diameter than a second end;

pivotally connecting the elongated members with the connectors intermediate opposing ends of each member to form a plurality of scissor linkages;

pivotally connecting a plurality of the ends of the elongated members to each other to form a first and second leg, having correspondingly configured shapes and correspondingly located connectors;

providing one or more connecting rods, one of the connecting rods or the connectors having a protrusion and the other of the connecting rods or the connectors having a correspondingly located recess so the protrusion and recess engage to fasten the rods to the connectors; and fastening the connecting rods to the correspondingly located connectors to interconnect the first leg and the second leg.

14. The method of claim 13, further comprising the step of providing a plurality of fasteners having a shaft configured to engage the second end of the connectors to prevent removal of the connectors from the elongated members.

15. A method of forming a laundry stand, comprising:

providing a plurality of pairs of elongated members, the members having holes therein;

providing a plurality of connectors, each of the connectors having a first end and a second end with an outwardly extending flange therebetween;

pivotally connecting pairs of the elongated members by placing the connectors through the holes to form a plurality of scissor linkages;

pivotally connecting a plurality of the ends of the scissor linkages to each other by placing the connectors through holes in the ends of the linkages to form a first leg and a second leg, the first leg and the second leg having corresponding sizes and corresponding connectors;

providing a plurality of connecting rods;

fastening the connecting rods to the correspondingly located connectors to interconnect the first leg and the second leg; and placing cooperative engaging members on ends of the rods and on the connectors so that when engaged, the members restrain the rods from being removed from the legs.

16. The method of claim 15, further comprising the step of placing a fastener on the second end of the connectors to prevent removal of the connector from the legs.

17. A kit for constructing a stand to support laundry, comprising:

a plurality of connectors, each of the connectors having a first end with a larger outside diameter than a second end;

a plurality of pairs of elongated members, each pair of members having aligned holes through which the connectors can be inserted to pivotably connect the pair of members to form a plurality of scissor linkages, the ends of each pair of scissor linkages having corresponding holes through which the connectors can be inserted to join two scissor linkages, at least two scissor linkages being joinable to form a first leg, and at least two scissor linkages being joinable to form a second leg;

a plurality of connecting rods configured to be fastened to one end of the connectors to interconnect the first leg and the second leg; and a plurality of fasteners having a shaft configured to engage the second end of the connectors.

18. A kit for constructing a stand to support laundry, comprising:

a plurality of connectors, each of the connectors having a first end with a larger outside diameter than a second end;

a plurality of pairs of elongated members, each pair of members having aligned holes through which the connectors can be inserted to pivotably connect the pair of members to form a plurality of scissor linkages, the ends of each pair of scissor linkages having corresponding holes through which the connectors can be inserted to join two scissor linkages, at least two scissor linkages being joinable to form a first leg, and at least two scissor linkages being joinable to form a second leg;

a plurality of connecting rods configured to be fastened to one end of the connectors to interconnect the first leg and the second leg; and a plurality of inwardly extending ribs on an inner surface of an opening in the first end of the connectors sized relative to the rods to form an interference fit with an outside of an end of the rods.

19. A kit for constructing a stand to support laundry, comprising:

a plurality of connectors, each of the connectors having a first end with a larger outside diameter than a second end;

a plurality of pairs of elongated members, each pair of members having aligned holes through which the connectors can be inserted to pivotably connect the pair of members to form a plurality of scissor linkages, the ends of each pair of scissor linkages having corresponding holes through which the connectors can be inserted to join two scissor linkages, at least two scissor linkages being joinable to form a first leg, and at least two scissor linkages being joinable to form a second leg;

a plurality of connecting rods configured to be fastened to one end of the connectors to interconnect the first leg and the second leg; and wherein one of the connectors or the connecting rods has a protrusion and the other of the connectors or the connecting rods has a correspondingly located recess so the protrusion and recess engage to fasten the rods to the connectors.

20. The kit as defined in claim 19, wherein the protrusion is on the connecting rod.

21. The kit as defined in claim 19, wherein the protrusion is on the connector.

22. The kit as defined in claim 19, wherein the first end of the connector further comprises an elongated body having a first annular portion sized or configured to prevent passage through one of two aligned holes in the elongated members, the second end of the connector forming a locking portion coaxial with the first portion, the second locking portion sized to extend through one of the aligned holes in the elongated members when assembled to form the stand; and a fastener having a shaft and a head, the shaft being sized and configured to be inserted into an opening in the second locking portion, wherein when the second locking portion of the elongated body extends through the opening in the aligned hole in the elongated member, the fastener can be attached to the second end of the elongated body with the head of the fastener being configured to restrain passage of the head through one of the aligned holes in the elongated members.

23. The kit as defined in claim 22, further comprising a collar positioned between the first annular portion and the second locking portion, the collar being sized larger than the aligned hole in the elongated member through which the connector extends to prevent the entire connector from passing through the aligned hole in the elongated member, the collar being located such that it is positioned on an opposing side of the elongated member than the head of the fastener.

24. The kit as defined in claim 19, further comprising at least one resilient member having the protrusion on a distal end of the member, the resilient member being flexed to engage the protrusion with the recess to resiliently urge the protrusion toward the recess.

25. A stand for supporting laundry, the stand having collapsible legs joined at their middle and at their ends, comprising:

a collapsible first leg including a plurality of elongated members pivotably connected at a middle part and at least at some joined ends of the members of the first leg, the first leg having a first distal end and a second distal end;

a collapsible second leg including a plurality of elongated members pivotably connected at a middle point and at least at some joined ends of the elongated members of the second leg, the second leg having a first distal end and a second distal end;

connectors attached to the first leg, each of the connectors having a first end configured to be fastened to a connecting rod and a second end configured to be inserted through one or more openings in the first leg;

connectors attached to the second leg, each of the connectors having a first end configured to be fastened to a connecting rod and a second end configured to be inserted through one or more openings in the second leg;

one or more connecting rods having opposing ends fastened to the first end of the connectors in the first and second legs to interconnect the first leg and second leg; and a first projection configured and located to engage a recess in the connecting rod engaging the connector.

26. A stand as defined in claim 25, wherein the first end of the connectors is configured to resiliently urge the first projection to engage the recess.

27. The stand of claim 25, wherein a plurality of the connectors comprise:

a body having a first end and a second end with a cavity in one end and an outwardly extending flange between the ends, and further having a protrusion extending outward adjacent a distal end of one of said first and second ends, the first end being sized to extend through one of the holes in the elongated members, and the second end being adapted to connect to one end of one of the connecting rods.

28. The stand of claim 27, wherein the first and second ends are cylindrical with the cavity defining a cylindrical hole in the first end, the flange comprising an annular flange, and the protrusion extending radially outward from an exterior surface of the second end.

29. The stand of claim 25, further comprising a fastener with a shaft configured to engage the cavity, the fastener having an enlarged head that cannot pass through the hole in the elongated member through which the first end passes.

* * * * *